US005441280A

United States Patent [19]

Copius

[11] Patent Number: 5,441,280

[45] **Date of Patent: * Aug. 15, 1995**

[54] CONTAMINANT RECOVERY SYSTEM FOR A RIFLE RANGE

[75] Inventor: Craig C. Copius, Seaford, N.Y.

[73] Assignee: Copius Consultants, Inc., Seaford, N.Y.

[ * ] Notice: The portion of the term of this patent subsequent to Oct. 26, 2010 has been disclaimed.

[21] Appl. No.: 120,155

[22] Filed: Sep. 10, 1993

Related U.S. Application Data

[63] Continuation of Ser. No. 829,500, Feb. 3, 1992, Pat. No. 5,255,924.

[51] Int. Cl.[6] ..... F41J 1/14

[52] U.S. Cl. ..... 273/410; 209/158

[58] Field of Search ..... 273/410, 404; 209/155, 209/157, 158

[56] References Cited

U.S. PATENT DOCUMENTS 4,728,109 3/1988 Simonetti ..... 273/410

*Primary Examiner*—William H. Grieb

*Attorney, Agent, or Firm*—Galgano & Burke

[57] ABSTRACT

A contaminant recovery system for a rifle range having an upstanding retaining wall which serves as a rear wall for the range. A sloped berm is located in front of the rear wall and serves as a target backstop. Drainage means are provided for collecting and diverting water which passes through the berm and for recovering contaminants in the water. A base wall may be located beneath the sloped berm which abuts the retaining wall.

1 Claim, 3 Drawing Sheets

CONTAMINANT RECOVERY SYSTEM FOR A RIFLE RANGE

This is a continuation of application Ser. No. 07/829,500 filed on Feb. 3, 1992, now U.S. Pat. No. 5,255,924.

BACKGROUND OF THE INVENTION

1. Field of the Invention

The invention relates to a range system for placement behind the targets of a rifle range. More particularly, it relates to a closed system having a sand backstop and a drainage system which contains the lead from bullets and prevents it from entering into the ground water.

2. Description of the Prior Art

Prior art ranges are known which have sand backstops. A bullet which is shot into a sand backstop remains virtually in tact, i.e. remains in one piece. However, these prior art ranges do not protect the ground water from lead contamination nor do they provide an efficient way to reclaim the lead.

Other known ranges have a backstop constructed of a steel bullet trap with metal plates. When a bullet hits the plate, it brakes up into many pieces and is deflected away from the shooter. However, if a large number of rounds are being shot at one time, bullet fragments may be reflected back at the shooters from the metal plates. As can be appreciated, a considerable safety hazard is created.

SUMMARY OF THE INVENTION

It is, therefore, an object of the present invention to eliminate the aforementioned drawbacks of the prior art and to provide a range system which captures bullets in one piece.

It is a further object of the present invention to provide such a range system which allows safe and simple recovery of used or spent bullets.

It is yet a further object of the invention to provide a range system which contains the lead and keeps it from entering the ground water.

These and other related objects are obtained according to the invention by a contaminant recovery system for a rifle range, including an upstanding retaining wall which serves as a rear wall for the range. A sloped berm is disposed in front of the rear wall and serves as a target backstop. Drainage and collection means for diverting and collecting water which passes through the berm and for recovering contaminants in the water are provided.

In addition, the system may include a relatively horizontally disposed base wall which is located beneath the sloped berm and which abuts the retaining wall. The upstanding retaining wall and the base wall form the rear corner of the contaminant recovery system. The system may also be provided with a drainage and collection means which includes a drainage pipe located between the base wall and the sloped berm. A catch basin may optionally be provided which is located exteriorly of the sloped berm which is operatively connected to the drainage pipe. The drainage pipe collects water which passes through the berm and diverts it to the catch basin where contaminants collect and are recovered and from which uncontaminated water passes through. There may also be a series of catch basins where the drainage pipe collects water and diverts it to one catch basin until filled and then along to other catch basins, in series.

The base wall may form a depression in the area of the drainage pipe to, assist in draining water from the sloped berm out through the drainage pipe. The catch basin may be made of concrete, for example. To further assist the drainage, a water-proof liner may be located above the base wall and below the drainage pipe and sloped berm. This water-proof liner prevents contaminants from seeping through the base wall and helps to direct water and contaminants towards the drainage pipe.

The sloped berm may be made of sand, for example. The retaining wall and base wall may be made of concrete, for example.

Several layers of rocks may surround the drainage pipe in order to prevent the sand of the sloped berm from entering the drainage pipe. Optionally, a layer of drainage fabric may be placed within the sloped berm, generally above the drainage pipes, to prevent contaminants from entering the drainage pipe.

The contaminant recovery system could be constructed as follows, for example. The backstop area is created by first grading the ground underneath the backstop. Depending on the soil conditions and drainage requirements, a 12" layer of compacted clay may optionally be placed on the graded ground. On top of this, a six inch layer of reinforced concrete is poured. An upstanding retaining wall which serves as a rear wall for the range is constructed which meets the concrete base at the lower back corner of the system. A thick plastic liner is placed over the concrete slab and also continues up the retaining wall. This plastic liner ensures that any water which enters the backstop region which contains lead is kept from running unchecked into local groundwater.

On top of the plastic liner is placed one or more drainage pipes for the water. Over the pipe is set stones which act as a filter and allow water to seep into the pipe without it being clogged by sand. After the stones are in place, a sloped berm, made of sand, is poured into the backstop area and provided with an approximately 45° grade. Any water which enters the backstop area will seep through the rocks and exit the backstop area through the pipes.

As the pipes exit the backs top area, they enter a catch basin where any lead which is in the water settles out. Depending on the drainage requirements, this catch basin could spill over into one or more additional catch basins all of which contain the lead and prevent it from exiting the system. The lead can then be recovered from the bottom of these catch basins periodically.

The back retaining wall can be constructed from cement blocks, poured concrete, railroad ties or other suitable materials. It is important that the backstop form a water proof seal between the sand and the ground outside the backstop area. In this manner, water is not able to enter the backstop area, become contaminated with lead and then exit the range system without being appropriately filtered.

Additionally, the sand which forms the backstop area can be periodically sifted to remove the lead bullets which generally remain intact upon impact with the backstop.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as definition of the limits of the invention.

In the drawings, wherein similar reference characters denote similar elements throughout the several views.

DETAILED DESCRIPTION OF THE PREFERRED EMBODIMENTS

Figure 1:
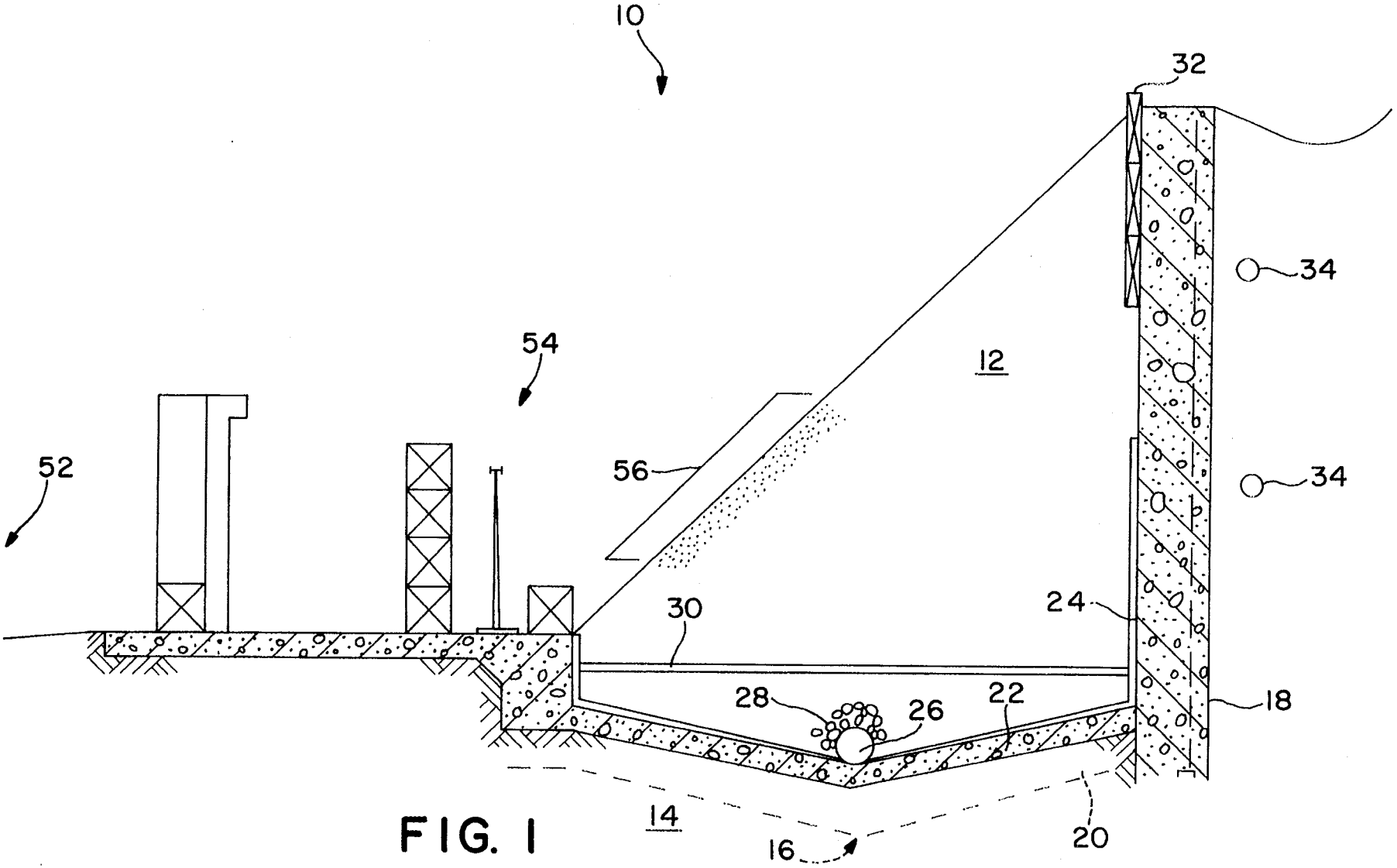
FIG. 1 is a side-elevational view of a range system embodying the present invention.

Referring now in detail to drawings, and in particular to FIG. 1, there is illustrated a range system 10 embodying the present invention, including a backstop area 12 where the bullets are stopped and contained. The backstop is constructed in the following manner: An of ground 14 is selected and graded to form a depression at point 16, for example. This grade is provided to facilitate draining of water from backstop 12. For larger backstops, it may be necessary to provide more than one depression along the length of the base. Also, area 14 can be graded so that point 16 is located nearer to or farther from retaining wall 18.

Optionally, a layer of clay 20 is placed over the graded area 14. If the range is close to the water table, it is preferable to have a 12" layer of compacted clay. Next, a layer of concrete 22 is poured over the layer of clay 20. This concrete layer 22 also joins to concrete retaining wall 18. The concrete layer 22 could be, for example, a 4" thick concrete slab or 6" of 3000 lb reinforced concrete.

A waterproof liner 24 lays over concrete layer 22 and runs continuously up along the inside portion of retaining wall 18. Water proof liner 24 can be made of polyethylene EPDM or equivalent, for example. Next, a drainage pipe 26 is placed over the water proof liner 24 and is located above point 16. Then drainage pipe 26 will be covered with small rocks 28 in order to prevent the sand from entering drainage pipe 26. The stones can be, for example, 3-inch stones and can be placed 12 inches thick around drainage pipe 26.

Next, backstop 12 is created by filling in the area between concrete layer 22 and retaining wall 18 with sand. The sand which forms backstop 12 is preferably graded at a 45° angle. Optionally, a layer of drainage fabric 30 can be placed just above drainage pipe 26 and rocks 28.

Also, wooden boards 32 may be placed along the upper portion of retaining wall 18. This is to minimize the possibility of ricochets if a section of concrete retaining wall 18 becomes exposed due to erosion of the sand in backstop 12.

Additionally, drainage pipes 34 will be located behind retaining wall 18 to drain water away from retaining wall 18.

Figure 2:
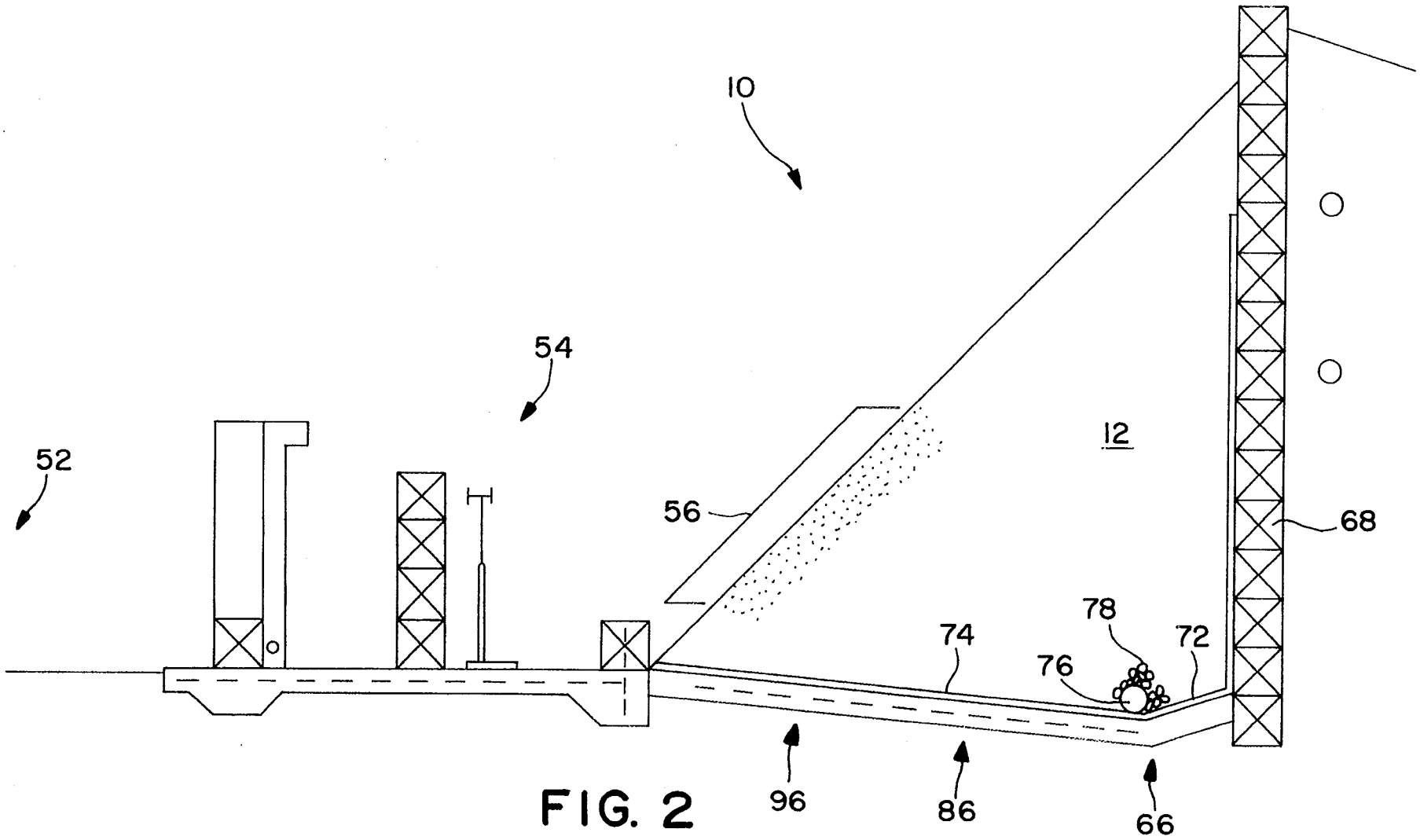
FIG. 2 is a side-elevational view of an alternate embodiment of a range system.

An alternate embodiment of the invention is shown in FIG. 2. The depression point 66 which corresponds to depression point 16 of FIG. 1 is located closer to retaining wall 68. Concrete layer 72 and waterproof liner 74 correspondingly have their depression point shifted back above point 66. Drainage pipe 76 and layer rocks 78 are also located at point 66. Also, FIG. 2 shows retaining wall 68 made from railroad ties, for example.

Figure 3:
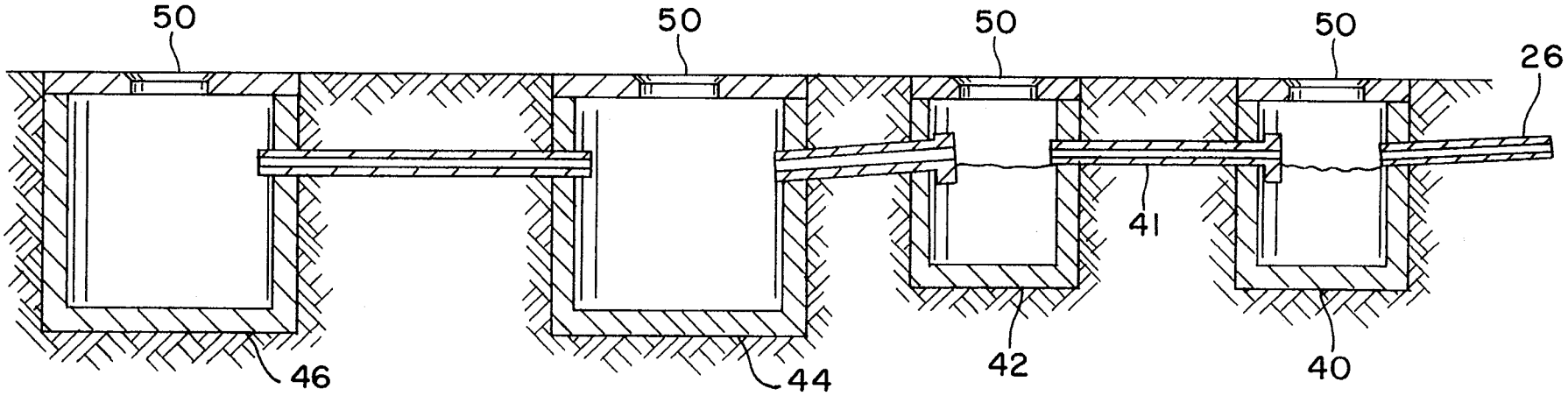
FIG. 3 is a side-elevational view of a dry well for filtering water which passes through the range system.

In the embodiment according to FIG. 1 or FIG. 2, drainage pipe 26 (or drainage pipe 76) exits the side of the range system and enters a first filtering dry well 40 shown in FIG. 3. Filtering dry well 40 can additionally spill over into second filtering dry well 42, third filtering dry well 44, or fourth filtering dry well 46, as drainage requirements dictate. Each of the filtering dry wells can optionally be provided with a manhole cover 50 which would allow access to the filtering dry wells for repair, replacement, collection of lead, etc.

In operation, individuals at point 52 would shoot at targets 54 with the bullets passing into backstop 12. Surprisingly, it was found that the bullets located in backstop 12 were generally concentrated in a surface area 56. Also, most of the bullets were only slightly below the surface of backstop 12. After a predetermined period of time, the sand in backstop 12 or a portion of sand in backstop 12 can be filtered for lead and returned to backstop 12. Since the sand in backstop 12 is within a closed confined area, there is a known amount of sand. The sand can be carried off and sifted remotely or sifted right at the site. Also, it is possible to sift the sand from area 56, with the sifted sand being placed back on top of backstop 12 to fill in for the sand which was removed for filtering.

Rain water which enters backstop 12 may come into contact with the spent lead bullets. The water then drains down initially to a layer of drainage fabric 30 which may provide filtering for large particles. The water eventually comes into contact with waterproof liner 24 and due to the grade runs down to drainage pipe 26 located at depression point 16. Rocks 28 are provided to prevent sand and other particulate matter from entering drainage pipe 26. Water then exits the backstop and enters first filtering dry wall 40, as seen in FIG. 3. Any lead particles or other particulate matter which passed into drainage pipe 26 will settle out in filtering dry well 40. When the water reaches a predetermined level, it will pass through pipe 41 into second filtering dry well 42. As each successive dry well fills up, the water will then spill over via connecting pipe into the next filtering dry well. A sufficient number of dry wells should be provided to account for the greatest expected rainfall in a particular region. In this manner, lead and other impurities will fall out in one or more filtering dry wells 40, 42, 44 and 46 and will not be released from the system into the ground water. Manhole covers 50 may be utilized to periodically inspect the dry wells and recover any lead or particulate matter which has accumulated there.

In areas where there is particularly heavy rainfall or if a particularly large backstop 12 is required, more than one drainage pipe may be required. As seen in FIG. 2, it would be possible to provide additional depression points and drainage pipes at points 86 and 96, for example. Each depression point could contain its own drainage pipe and layer of rocks. Each drainage pipe, as it exits the system, would have a series of filtering dry wells, as shown in FIG. 3. It is also possible to have the drainage pipes exit on both sides of the system with a filtering dry well on both sides.

As can be appreciated, the contaminant recovery system described herein can be modified in many ways to accommodate space restrictions and other design considerations. The base wall and rear retaining wall can be made of a variety of materials, for example concrete, wood, plastics, and other natural and synthetic materials. In addition, any type of impact-absorbing material can be placed along the upper portion of retaining wall 18, i.e. in place of wooden boards 32.

Although we have described backstop 12 as being made of sand, it can also be made from any type of impact-absorbing or granular material. The contaminant recovery system can be constructed either indoors or outdoors. The shooting range may be of any type, and the contaminant recovery system itself can be of any dimensions.

While only two embodiments have been shown and described, it is to be understood that many changes and modifications may be made thereunto without departing from the spirit and scope of the invention as defined in the appended claims.

What is claimed is:

1. A contaminant recovery system for a rifle range, comprising:

an upstanding retaining wall which serves as a rear wall for the range;

a sloped berm disposed in front of said rear wall which serves as a target backstop; and drainage and collection means for diverting and collecting water which passes through said berm and for recovering contaminants in the water, said drainage and collection means additionally including a relatively horizontally disposed base wall located beneath said sloped berm which abuts said retaining wall, and a drainage pipe located between said base wall and said sloped berm, which collects water and contaminants which pass through said berm.

* * * * *